United States Patent [19]

Dubois

[11] 4,098,388

[45] Jul. 4, 1978

[54] PRINTING WIRE FOR USE IN A MATRIX PRINTER AND METHOD FOR MAKING SAME

[75] Inventor: Jean-Pierre Dubois, Bôle, Switzerland

[73] Assignee: Fabrique d'Horlogerie CHS, Tissot & Fils. S.A., Le Locle, Switzerland

[21] Appl. No.: 738,921

[22] Filed: Nov. 4, 1976

[51] Int. Cl.[2] ..... B41J 3/44; C25D 5/02; C25D 7/06

[52] U.S. Cl. ..... 400/124; 204/15; 204/27

[58] Field of Search ..... 204/15, 27, 224 R, 38 E; 197/1 R

[56] References Cited

U.S. PATENT DOCUMENTS

| | | | |
|---|---|---|---|
| 2,802,897 | 8/1957 | Hurd et al. | 204/38 E |
| 3,276,986 | 10/1966 | Swistun | 204/224 R |
| 3,616,283 | 10/1971 | Magee | 204/27 |
| 3,669,850 | 6/1972 | Draca | 204/27 |
| 3,900,094 | 8/1975 | Larsen et al. | 197/1 R |

*Primary Examiner*—T. M. Tufariello

*Attorney, Agent, or Firm*—Griffin, Branigan and Butler

[57] ABSTRACT

A method is disclosed for providing tungsten carbide wires as used in matrix printers with a supporting surface at one end thereof thereby to facilitate the moulding thereon of a plastic cap and to improve retention of the cap. The supporting surface is provided by a galvanic nickel deposit.

3 Claims, 3 Drawing Figures

PRINTING WIRE FOR USE IN A MATRIX PRINTER AND METHOD FOR MAKING SAME

BACKGROUND OF THE INVENTION

In matrix printers use is made of a bundle of printing wires assembled in a predetermined square or rectangular format and in which certain wires are selected and then displaced longitudinally. Thereafter, displacement of the entire bundle effects printing. The present invention concerns the wires themselves rather than the overall printing arrangement, nevertheless the nature of the printer is such as to dictate the problem which the invention solves.

In effect, the wires are preferably composed of a hard material such as tungsten carbide. In order to use such wires, it is desirable that one end be provided with a suitable cap, preferably of a plastics material and the use of such caps facilitates greatly the longitudinal displacement of the wires within the matrix. The other end of the wire of course is the striking end.

To attach such caps to the ends of the wires it has been customary to mould them over such wires. This in turn necessitates a support arrangement on the wire itself since the cap is of a plastics material very much softer than the wire material and at the same time the wire may be of extremely fine gauge.

In prior art arrangements it has been customary either to form one end of the wire as a loop or alternately to apply a material such as solder or brazing metal to one end. In the first case a problem arises from the nature of the wire material wherewith loop forming is a difficult operation owing to the hardness and brittleness of the wire which as mentioned previously will probably be of a material such as tungsten carbide. Heating would be required and this will alter the wire crystalline structure. In the case where it is desired to apply a drop of metal such as solder or brazing metal this also involves heating the wire and thereby altering its crystalline qualities.

It is the problems in the known type of wires to which the present invention is addressed.

SUMMARY OF THE INVENTION

Accordingly, the invention proposes a filiform article of predetermined length made from a hard metallic material on one end of which is moulded a cap member of organic plastics material wherein the aforesaid one end is initially provided with an enlarged supporting surface comprising a galvanic nickel deposit.

Such wires exhibit better qualities and may be more easily and readily adapted to matrix printers than the wires known from the prior art.

DETAILED DESCRIPTION OF THE INVENTION

In the invention the wires 1 (FIG. 3) are provided with a galvanic deposit 2 of nickel. Standard methods of nickel plating are employed and in this case a rapid deposit is preferred to the desired volume. The desired volume of course will depend on the size of the wire itself and on the size of the cap which is eventually to be moulded thereover. The wires thus to be treated are accordingly provided initially with a resist whereby to localize and limit the deposit to one end. The resist thereafter is removed over the region proximate the end to be provided with the deposit and the wires thereafter following suitable preliminary treatment including cleaning and pickling as well as the usual rinsing steps are placed in a bath which may be of the following composition:

| | |
|---|---|
| Nickel Sulphate $Ni\ SO_4 . 7\ H_2O$ | 150 gram/liter |
| Magnesium Sulphate $Mg\ SO_4 . 7\ H_2O$ | 22 gram/liter |
| Boric Acid $H_3\ BO_3$ | 10 gram/liter |
| Sodium Chloride Na Cl | 6 gram/liter |
| Temperature: 20 – 25° C | |

Also within the bath there will be placed an anode of pure nickel and a tension of 1–1.5 Volts will be applied. It is found that with a current density of 0.5 amp/dm$^2$ and a 15 minute deposit time that the required deposit is achieved.

Figure 1:
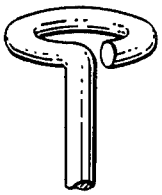
FIG. 1. PRIOR ART
FIG. 1 shows one form of cap support for a tungsten carbide wire of the prior art prior to moulding the cap thereover.
Figure 2:
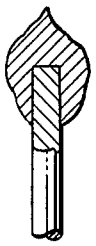
FIG. 2. PRIOR ART
FIG. 2 shows another prior art form prior to moulding.
Figure 3:
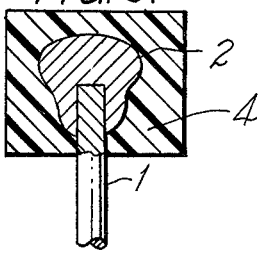
FIG. 3 shows the form achieved with the present invention prior to moulding.

When the wires are now removed from the bath they will be found to have a deposit resembling that shown in FIG. 3. FIGS. 1 and 2 show the form of arrangement as used in prior art wherein the loop arrangement of FIG. 1 was unsuitable owing to the necessity of heating and upsetting the wire and thereby altering its crystalline structure and the second form as shown in FIG. 2 was likewise unsuitable in view of the heating involved. Since the form as shown in FIG. 3 and in accordance with the invention involves no heating there is no crystalline structure alteration. In view of the method used it is possible to batch process a large number of wires at the same time thus overcoming a major difficulty of the prior art methods. Accordingly, a considerable improvement and rationalization has been achieved in the preparation of printing wires.

As in prior art arrangements following the provision of the enlarged supporting surface the wires are given the overmoulding in plastic and may thereafter be finished in any way necessary for the incorporation into a wire matrix printer.

What I claim is:

1. A printing wire; for use in a matrix printer of predetermined length, made from a hard metallic material on one end of which is moulded a cap member of organic plastic material wherein the aforesaid one end is initially provided with an enlarged supporting surface comprising a galvanic nickel deposit.

2. A printing wire as set forth in claim 1 wherein said metallic material comprises tungsten carbide.

3. A method of providing a supporting surface for a moulded plastic cap member on one end of a tungsten carbide wire comprising the steps of (a) coating the wire with a suitable resist, (b) removing the resist over a predetermined region proximate said one end, (c) placing the wire in a suitable electrolyte in which a nickel anode is provided and (d) applying an electric current between the wire and the anode for a period of time sufficient to assure a nickel deposit to a desired depth over said predetermined region.

* * * * *